US008578954B2

(12) United States Patent
Rappette

(10) Patent No.: US 8,578,954 B2
(45) Date of Patent: Nov. 12, 2013

(54) SPRAY ARM ASSEMBLY FOR A DISHWASHER

(75) Inventor: Antony Mark Rappette, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 906 days.

(21) Appl. No.: 12/643,427

(22) Filed: Dec. 21, 2009

(65) Prior Publication Data

US 2011/0146734 A1 Jun. 23, 2011

(51) Int. Cl.
*A47L 15/22* (2006.01)

(52) U.S. Cl.
USPC ..... 134/172; 134/180; 134/198

(58) Field of Classification Search
CPC ..... A47L 15/18; A47L 15/20; A47L 15/22; A47L 15/23
USPC ..... 134/198
See application file for complete search history.

(56) References Cited

U.S. PATENT DOCUMENTS

| | | | | | |
|---|---|---|---|---|---|
| 2,905,393 | A | * | 9/1959 | Federighi et al. | 239/110 |
| 3,261,554 | A | * | 7/1966 | Perl | 239/252 |
| 3,625,292 | A | * | 12/1971 | Lay | 172/13 |
| 3,837,917 | A | * | 9/1974 | Jenkins et al. | 134/144 |
| 3,876,148 | A | * | 4/1975 | Cushing et al. | 239/227 |
| 5,464,482 | A | * | 11/1995 | Michael et al. | 134/25.2 |
| 5,579,789 | A | * | 12/1996 | Spiegel | 134/104.1 |
| 5,725,002 | A | * | 3/1998 | Payzant | 134/95.3 |
| 2006/0232527 | A1 | * | 10/2006 | Oh | 345/87 |

FOREIGN PATENT DOCUMENTS

| | | | |
|---|---|---|---|
| EP | 0497913 B1 | | 8/1992 |
| GB | 962740 | | 7/1964 |
| GB | 1167845 | | 10/1969 |
| GB | 1282119 | * | 7/1972 |
| JP | 7225538 A | | 8/1995 |
| JP | 2002195313 A | | 7/2002 |

* cited by examiner

*Primary Examiner* — Michael Kornakov
*Assistant Examiner* — Marc Lorenzi

(57) ABSTRACT

A dishwasher includes a spray arm assembly positioned in the wash chamber of the dishwasher's tub. The spray arm assembly includes a corner arm that is driven by a gear train. The transfer gear assembly of the gear train is operable to decouple the gear train from its input when rotation of the corner arm is obstructed.

13 Claims, 5 Drawing Sheets

SPRAY ARM ASSEMBLY FOR A DISHWASHER

TECHNICAL FIELD

The present disclosure relates generally to a dishwasher and more particularly to a spray arm assembly for a dishwasher.

BACKGROUND

A dishwasher is a domestic appliance into which dishes and other cooking and eating wares (e.g., plates, bowls, glasses, flatware, pots, pans, bowls, etcetera) are placed to be washed. A dishwasher includes a number of dish racks which support such wares. During a cleaning cycle, the dishwasher sprays wash fluid (i.e., water and/or a wash chemistry) on the wares in the dish racks.

SUMMARY

According to one aspect, a dishwasher includes a tub defining a washing chamber. The tub includes a bottom wall having a downwardly-sloped sump formed therein. A number of dish racks are positioned in the washing chamber. A rotating spray arm assembly is positioned in the washing chamber to spray wash fluid on the dish racks. The rotating spray arm assembly includes a center arm that rotates relative to the bottom wall of the tub. A corner arm is coupled to the center arm so as to rotate relative thereto. The corner arm has an input gear. An upper transfer gear is coupled to the center arm and intermeshed with the input gear of the corner arm so as to drive rotation of the corner arm. The upper transfer gear has a downwardly extending drive shaft with a cam surface formed thereon. A lower transfer gear is coupled to the center arm. The lower transfer gear has an upwardly extending drive shaft with a cam surface formed thereon. The cam surface of the drive shaft of the lower transfer gear is engaged with the cam surface of the drive shaft of the upper transfer gear such that rotation of the lower transfer gear causes rotation of the upper transfer gear.

The lower transfer gear may be movable between a drive position in which the cam surface of the drive shaft of the lower transfer gear is engaged with the cam surface of the drive shaft of the upper transfer gear, and a slip position in which the cam surface of the drive shaft of the lower transfer gear is disengaged from the cam surface of the drive shaft of the upper transfer gear.

The upper transfer gear is driven by the lower transfer gear when the lower transfer gear is positioned in the drive position. The upper transfer gear rotates freely of the lower transfer gear when the lower transfer gear is positioned in the slip position.

The spray arm assembly may also be embodied with a spring that biases the lower transfer gear into the drive position. Movement of the lower transfer gear from the drive position to the slip position causes compression of the spring.

The dishwasher may also include a stationary center gear. The center arm rotates relative to the stationary center gear. The lower transfer gear is intermeshed with the stationary center gear such that rotation of the center arm relative to the stationary center gear causes rotation of the lower transfer gear.

The drive shaft of the lower transfer gear may have a bore extending therethrough. The drive shaft of the upper transfer gear has an elongated stem extending downwardly therefrom. The stem of the drive shaft of the upper transfer gear extends through the bore of the drive shaft of the lower transfer gear. The spring is positioned on the stem.

According to another aspect, a rotating spray arm assembly for a dishwasher includes a rotating center arm and a corner arm coupled to the center arm so as to rotate relative thereto. The corner arm has an input gear. An upper transfer gear is coupled to the center arm and intermeshed with the input gear of the corner arm so as to drive rotation of the corner arm. The upper transfer gear has a downwardly extending drive shaft with a cam surface formed thereon. A lower transfer gear is coupled to the center arm. The lower transfer gear has an upwardly extending drive shaft with a cam surface formed thereon. The cam surface of the drive shaft of the lower transfer gear is engaged with the cam surface of the drive shaft of the upper transfer gear such that rotation of the lower transfer gear causes rotation of the upper transfer gear.

The center arm includes a number of drive nozzles that cause rotation of the center arm when wash fluid is expelled therefrom.

The lower transfer gear may be movable between a drive position in which the cam surface of the drive shaft of the lower transfer gear is engaged with the cam surface of the drive shaft of the upper transfer gear, and a slip position in which the cam surface of the drive shaft of the lower transfer gear is disengaged from the cam surface of the drive shaft of the upper transfer gear.

The upper transfer gear is driven by the lower transfer gear when the lower transfer gear is positioned in the drive position. The upper transfer gear rotates freely of the lower transfer gear when the lower transfer gear is positioned in the slip position.

The spray arm assembly may also be embodied with a spring that biases the lower transfer gear into the drive position. Movement of the lower transfer gear from the drive position to the slip position causes compression of the spring.

The drive shaft of the lower transfer gear may have a bore extending therethrough. The drive shaft of the upper transfer gear has an elongated stem extending downwardly therefrom. The stem of the drive shaft of the upper transfer gear extends through the bore of the drive shaft of the lower transfer gear. The spring is positioned on the stem.

According to another aspect, a dishwasher includes a tub defining a washing chamber. The tub includes a bottom wall having a downwardly-sloped sump formed therein. A number of dish racks are positioned in the washing chamber. A center gear is positioned in the washing chamber. A rotating spray arm assembly is positioned in the washing chamber to spray wash fluid on the dish racks. The rotating spray arm assembly includes a center arm that rotates relative to the bottom wall of the tub. A corner arm is coupled to the center arm so as to rotate relative thereto. The corner arm has an input gear. A transfer gear assembly is intermeshed with both the center gear and the input gear of the corner arm so as to drive rotation of the corner arm. The transfer gear assembly is operable to decouple the input gear from the center gear when rotation of the corner arm is obstructed.

The dishwasher may also include a pump having an outlet that extends into the washing chamber through the bottom wall of the tub. The center gear is non-rotatably secured to the outlet of the pump. The center arm is rotatably secured to the outlet of the pump.

The transfer gear assembly may include an upper transfer gear coupled to the center arm. The upper transfer gear has a downwardly extending drive shaft with a cam surface formed thereon. The transfer gear may also include a lower transfer gear coupled to the center arm. The lower transfer gear has an upwardly extending drive shaft with a cam surface formed thereon. The cam surface of the drive shaft of the lower transfer gear is engaged with the cam surface of the drive shaft of the upper transfer gear such that rotation of the lower transfer gear causes rotation of the upper transfer gear.

The lower transfer gear may be movable between a drive position in which the cam surface of the drive shaft of the lower transfer gear is engaged with the cam surface of the drive shaft of the upper transfer gear, and a slip position in which the cam surface of the drive shaft of the lower transfer gear is disengaged from the cam surface of the drive shaft of the upper transfer gear.

The upper transfer gear is driven by the lower transfer gear when the lower transfer gear is positioned in the drive position. The upper transfer gear rotates freely of the lower transfer gear when the lower transfer gear is positioned in the slip position.

The spray arm assembly may also be embodied with a spring that biases the lower transfer gear into the drive position. Movement of the lower transfer gear from the drive position to the slip position causes compression of the spring.

BRIEF DESCRIPTION OF THE DRAWINGS

The detailed description particularly refers to the following figures, in which.

DETAILED DESCRIPTION OF THE DRAWINGS

Figure 1:
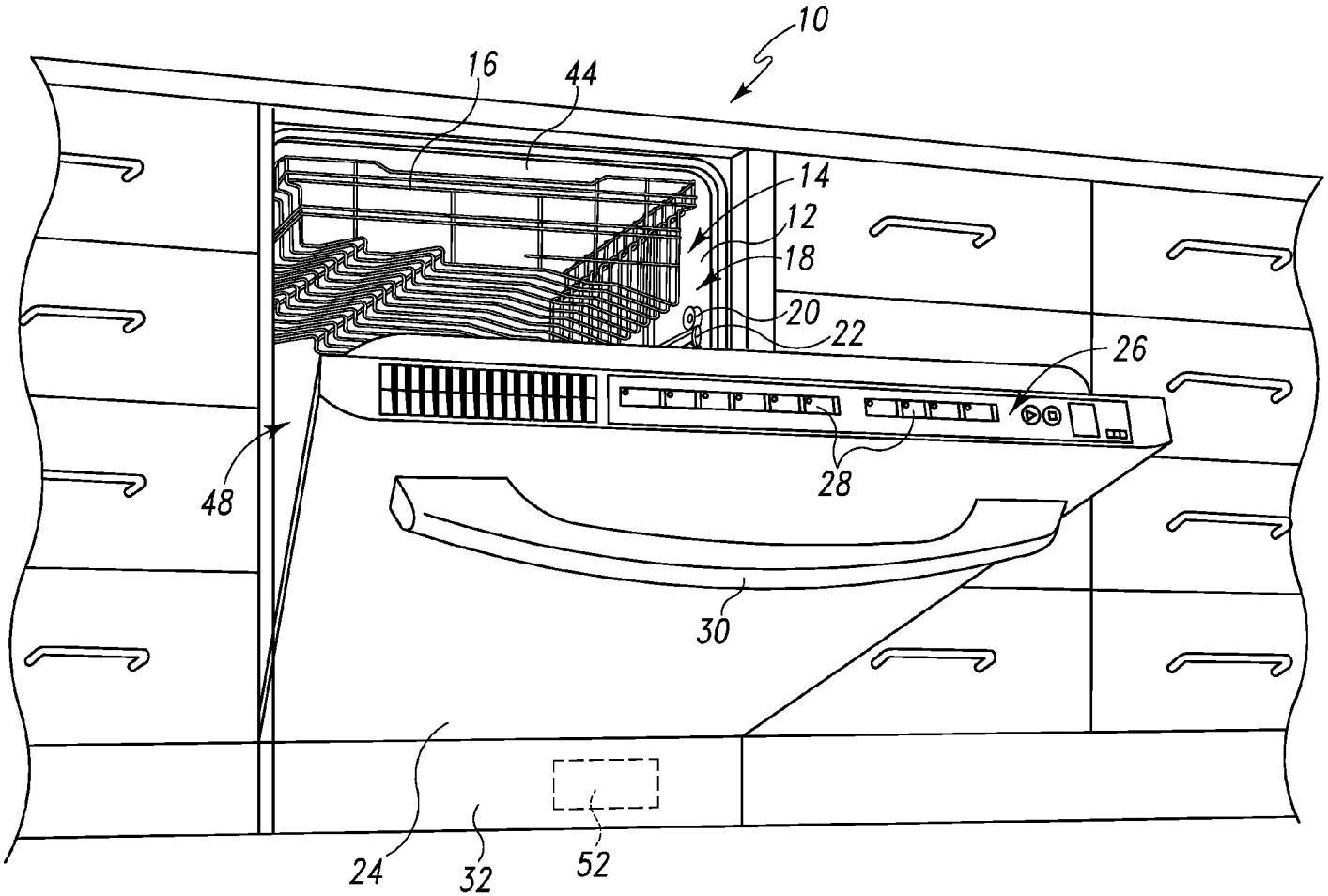
FIG. 1 is fragmentary perspective view of a dishwasher installed in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Figure 2:
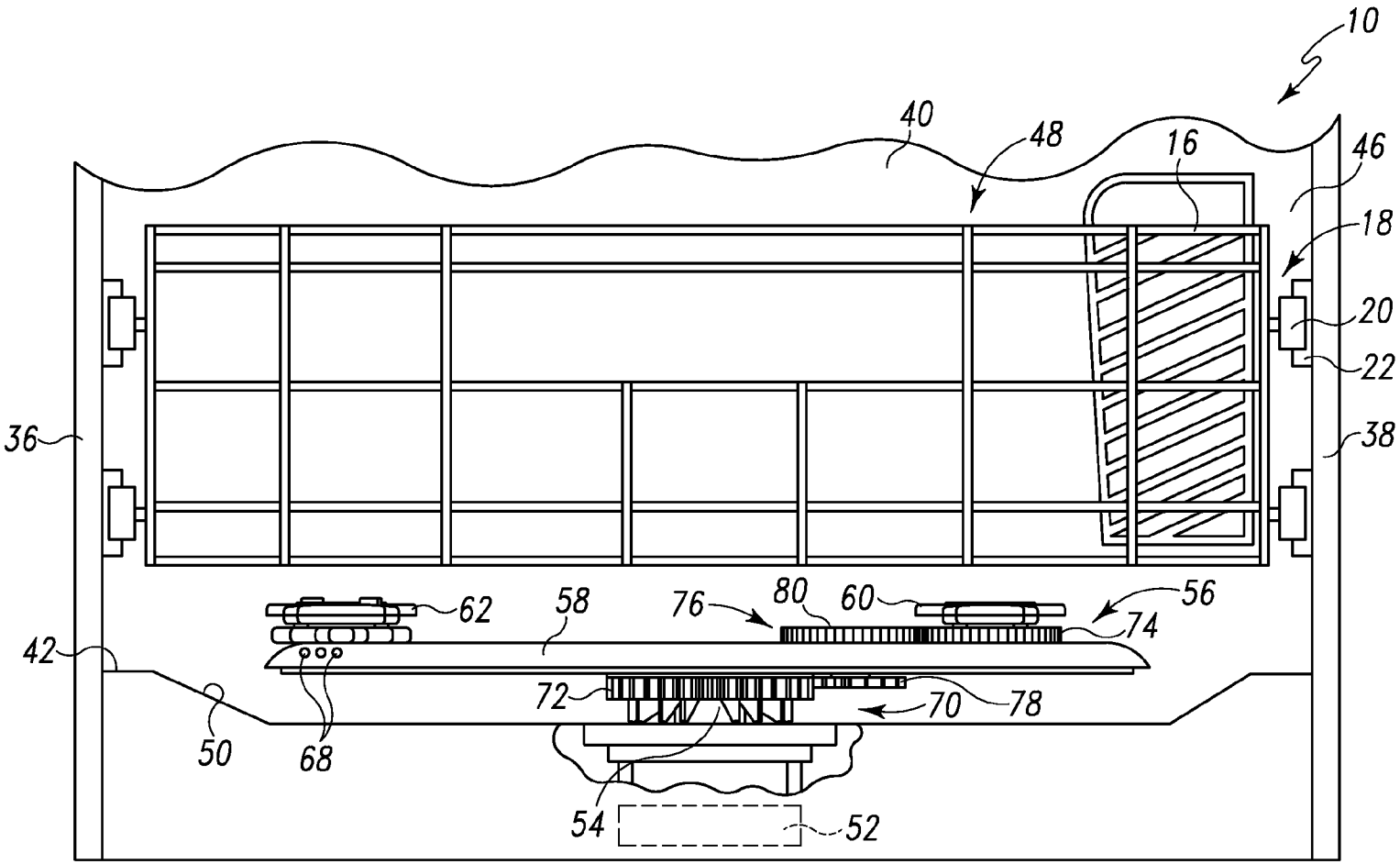
FIG. 2 is a fragmentary front elevation view of the dishwasher of FIG. 1, note the door has been removed for clarity of description.

Referring now to FIG. 1, there is shown a dishwasher 10 having a tub 12 which defines a washing chamber 14 into which dishes and other cooking and eating wares (e.g., plates, bowls, glasses, flatware, pots, pans, bowls, etcetera) are placed to be washed. The dishwasher 10 includes a number of racks 16 located in the tub 12. An upper dish rack 16 is shown in FIG. 1, and a lower dish rack 16 is shown in FIG. 2. A number of roller assemblies 18 are positioned between the dish racks 16 and the tub 12. The roller assemblies 18 allow the dish racks 16 to extend from, and retract back into, the tub 12. Such movement facilitates the loading and unloading of the dish racks 16. The roller assemblies 18 include a number of rollers 20 which roll along the top of, and in some cases the top and bottom of, a corresponding support rail 22.

A door 24 is hinged to the lower front edge of the tub 12. The door 24 permits access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, that are used to control operation of the dishwasher 10. A handle 30 is also included in the control panel 26. The handle 30 is operable by a user to unlatch the door 24 so that it may be opened by a user.

A machine compartment 32 is located below the tub 12. The machine compartment 32 is sealed from the tub 12. In other words, unlike the tub 12 which fills with water and is exposed to water spray, the machine compartment 32 does not fill with water and is not exposed to water spray during operation of the dishwasher 12. The machine compartment 32 houses components such as the dishwasher's water pump(s) and valve(s), along with the associated wiring and plumbing.

Referring now to FIG. 2, the tub 12 of the dishwasher 10 is shown in greater detail. The tub 12 includes a pair of side walls 36, 38 and a back wall 40 that extend upwardly from a bottom wall 42 to a top wall 44 (see FIG. 1), thereby defining the washing chamber 14. The open front side 46 of the tub 12 defines an access opening 48, which provides the user with access to the dish racks 16 positioned in the washing chamber 14 when the door 24 is open. When the door 24 is closed, the door 24 seals the access opening 48, thereby preventing the user from accessing the dish racks 16. The door 24 also prevents fluid from escaping through the access opening 48 of the dishwasher 10 during a dishwashing cycle.

Below the lower dish rack 16, a recirculation sump 50 is formed (e.g., stamped or molded) in the bottom wall 42 of the tub 12. In particular, as shown in FIG. 2, the sump 50 defines a reservoir that extends downwardly in a direction away from the lower dish rack 16. The sloped configuration of the bottom wall 42 directs wash fluid, such as water and/or wash chemistry (i.e., water and/or detergents, enzymes, surfactants, and other cleaning or conditioning chemistry), into the sump 50 during a dishwashing cycle. Wash fluid is drained from the sump 50 and re-circulated onto the dish racks 16, 18 by a wash pump 52 located in the machine compartment 32. The wash pump 52 has an outlet 54 that extends through a sealed hole formed in the bottom wall 42 of the tub 12. In the illustrative embodiment described herein, the pump outlet 54 is embodied as a tube that is formed in the housing of the pump 52. However, the pump outlet 54 may be embodied as a number of separate components (e.g., separate tubes) coupled to the housing of the pump 52 to direct wash fluid out of the pump 52 and into the washing chamber 14.

Figure 3:
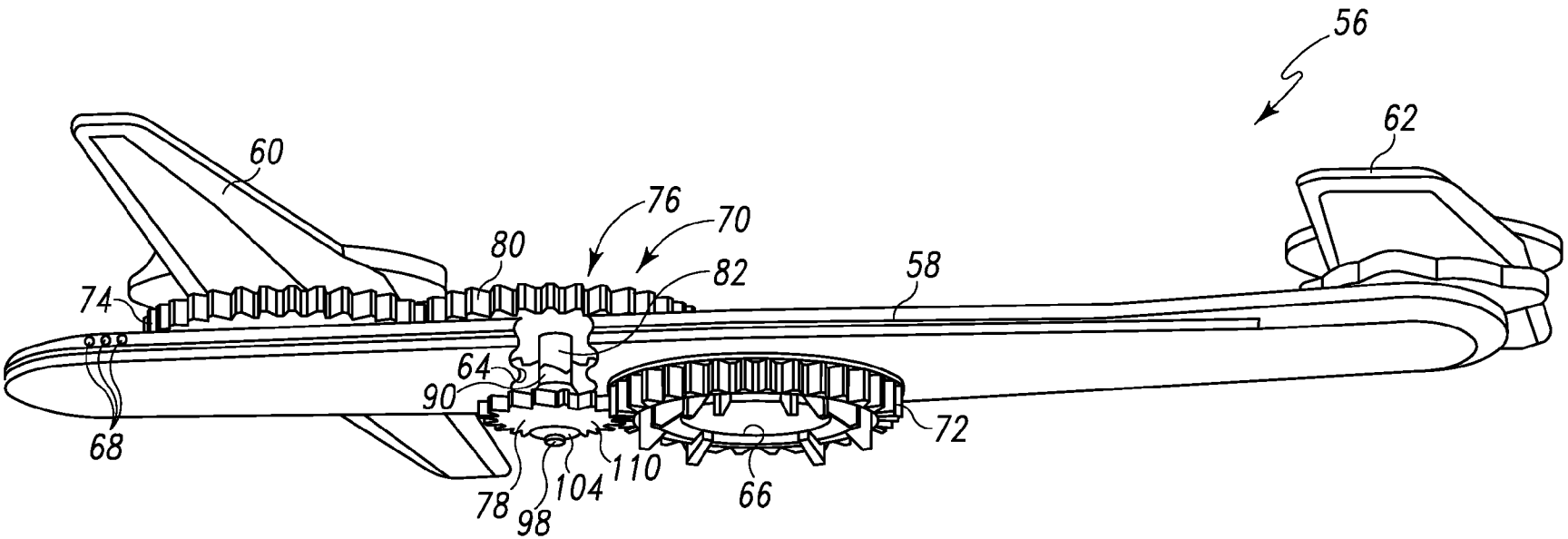
FIG. 3 is a perspective view of the spray arm assembly of the dishwasher of FIG. 1.

As shown in FIG. 2, wash fluid pumped from the pump 52 is supplied to a spray arm assembly 56. The spray arm assembly 56 is located in the tub and is operable to spray wash fluid (i.e., water or wash chemistry) on the dish racks 16 and hence the eating wares positioned therein. The spray arm assembly 56 includes a rotating center arm 58 having a corner arm 60 and a wing arm 62 coupled thereto. The center arm 58 rotates relative to the bottom wall 42 of the tub 12. Specifically, the center arm 58 is coupled to the outlet 54 of the pump 52 and rotates freely relative to the pump outlet 54. A bearing (not shown) may be used to facilitate such rotation of the center arm 58 relative to the pump outlet 54. The center arm 58 has a fluid chamber 64 formed therein. Wash fluid is pumped from the pump outlet 54 into the fluid chamber 64 via an the arm's fluid inlet 66 (see FIG. 3). Wash fluid is then delivered from the fluid chamber 64 to the corner arm 60 and the wing arm 62 where it is sprayed out of the arms 60, 62 through a plurality of nozzles (not shown) onto the dish racks 16 (and hence the wares positioned therein).

The center arm 58 is driven (i.e., rotated) by fluid pressure from the pump 52. Specifically, the center arm has a number of drive nozzles 68 formed therein. A portion of the pressurized wash fluid advancing through the center arm's fluid chamber 64 is expelled through the drive nozzles 68 thereby causing the center arm 58 to rotate about the pump outlet 54. In the illustrative embodiment described herein, the center arm 58 is driven in the clockwise direction, although it could be driven in the opposite direction to fit the needs of a given design.

The wing arm 62 is coupled to the upper wall of the center arm 58 and rotates freely relative to the center arm 58. A bearing (not shown) may be used to facilitate such rotation of the wing arm 62 relative to the center arm 58. Like the center arm 58, the wing arm 62 has a fluid chamber (not shown) formed therein. Pressurized wash fluid is advanced out of the fluid chamber 64 of the center arm 58 and into the wing arm's fluid chamber via a fluid inlet (not shown) located in the center of the wing arm 62. Wash fluid is sprayed out of the wing arm 62 through a plurality of nozzles (not shown) onto the dish racks 16 (and hence the wares positioned therein). Expelling wash fluid through the wing arm 62 also causes rotation of the wing arm 62 relative to the center arm 58.

The corner arm 60 is coupled to the upper wall of the center arm 58 and rotates freely relative to the center arm 58. A bearing (not shown) may be used to facilitate such rotation of the corner arm 60 relative to the center arm 58. Like the other arms of the spray arm assembly 56, the corner arm 60 has a fluid chamber (not shown) formed therein. Pressurized wash fluid is advanced out of the fluid chamber 64 of the center arm 58 and into the corner arm's fluid chamber via a fluid inlet (not shown) located in the center of the corner arm 60. Wash fluid is sprayed out of the corner arm 60 through a plurality of nozzles (not shown) onto the dish racks 16 (and hence the wares positioned therein).

However, unlike the wing arm 62, the corner arm 60 is not driven by fluid pressure from the pump 52, but rather is driven by a gear train 70. The input of the gear train 70 is a center gear 72. As can be seen in FIG. 2, the center gear 72 is fixed to the pump outlet 54. The center gear 72 is stationary. That is, it does not rotate relative to the pump outlet 54, but rather is fixed in place on it. As can be seen FIGS. 2 and 3, the corner arm 60 has an input gear 74. Rotation of its input gear 74 causes the corner arm 60 to rotate relative to the center arm 58.

A transfer gear assembly 76 couples the stationary center gear 72 to the input gear 74 of the corner arm 60. As will be described in more detail below, the transfer gear assembly 76 is operable to couple the input gear 74 of the corner arm 60 to the center gear 72 during normal operation of the spray arm assembly 56, while decoupling the input gear 74 of the corner arm 60 from the center gear 72 when rotation of the corner arm 60 is obstructed. In particular, if rotation of the corner arm 60 is obstructed by, for example, a pot handle or spoon extending downwardly from the lower dish rack 16, the transfer gear assembly 76 is configured to slip or otherwise decouple the input gear 74 of the corner arm 60 from the center gear 72 so as to prevent damage to the spray arm assembly 56.

The transfer gear assembly 76 includes a lower transfer gear 78 and an upper transfer gear 80. The lower transfer gear 78 is coupled to the lower wall of the center arm 58 and rotates freely of the center arm 58. The teeth of the lower transfer gear 78 are intermeshed with the teeth of the stationary center gear 72. As such, as the center arm 58 rotates about the pump outlet 54 (and hence the stationary center gear 72), the lower transfer gear 78 is driven (i.e., rotated) by the stationary center gear 72.

The upper transfer gear 80 is coupled to the upper wall of the center arm 58 and rotates freely of the center arm 58. The teeth of the upper transfer gear 80 are intermeshed with the teeth of input gear 74 of the corner arm 60. As such, rotation of the upper transfer gear 80 drives the input gear 74 of the corner arm 60 thereby causing rotation of the corner arm 60 relative to the center arm 58.

Figure 4:
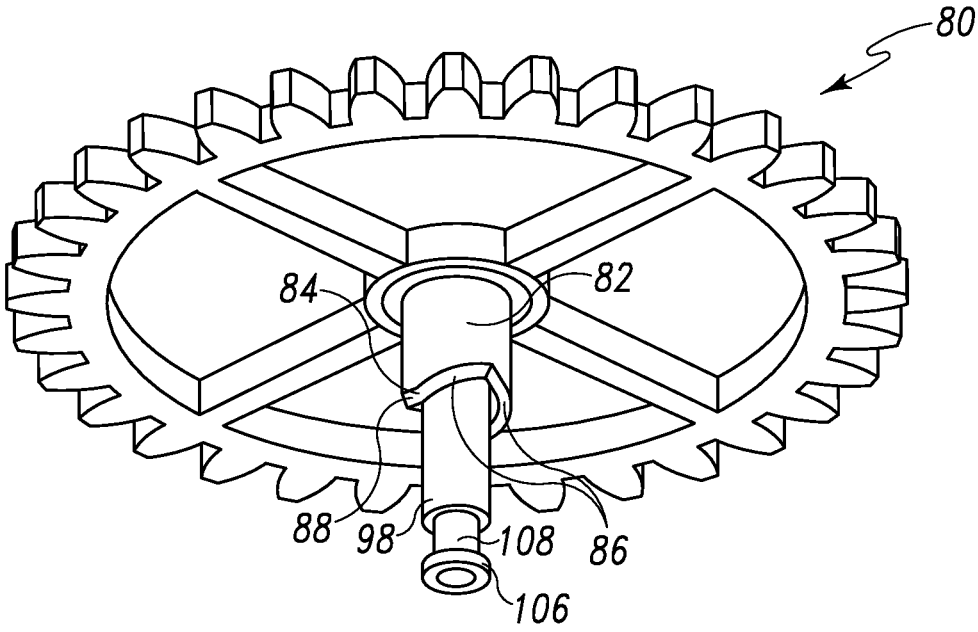
FIG. 4 is a perspective view of the upper transfer gear of the spray arm assembly of FIG. 3.
Figure 5:
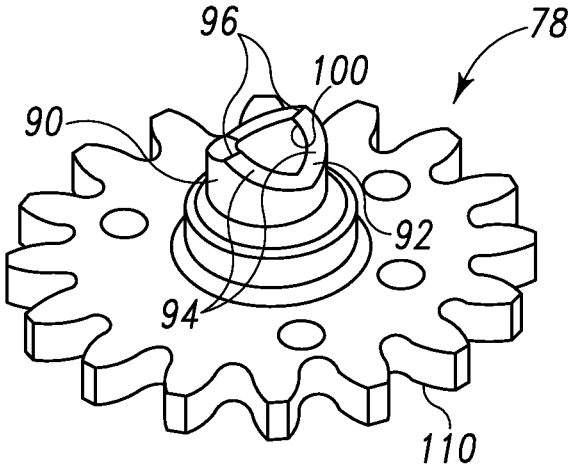
FIG. 5 is a perspective view of the lower transfer gear of the spray arm assembly of FIG. 3.
Figure 6:
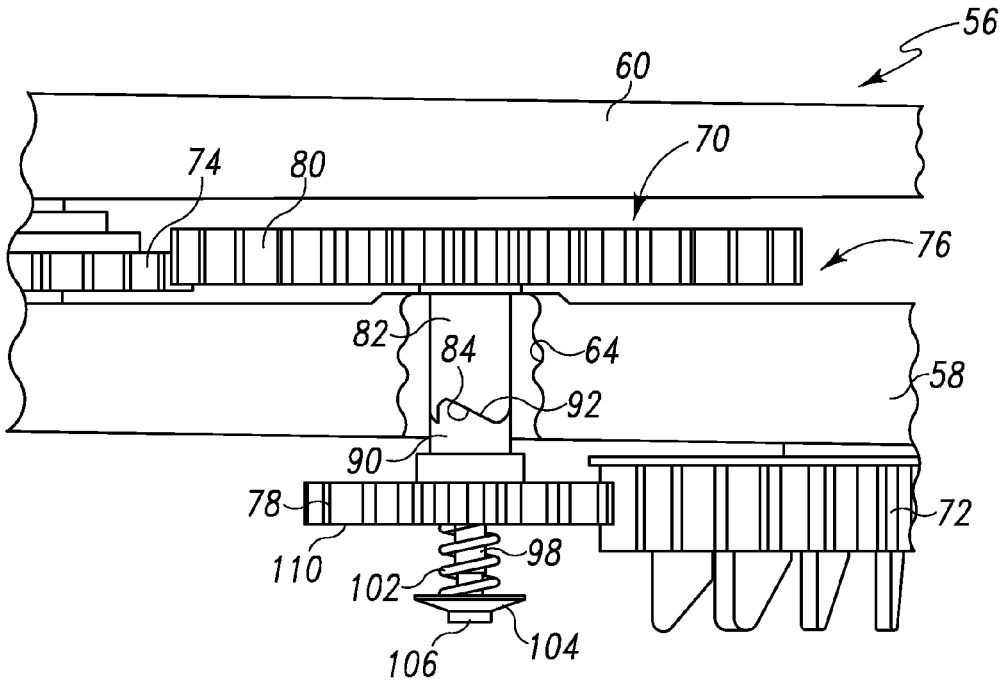
FIG. 6 is a fragmentary elevation view showing the lower transfer gear of the spray arm assembly positioned in its drive position.

The upper transfer gear 80 has a downwardly extending drive shaft 82. As can be seen in FIG. 4, the distal end of the drive shaft 82 has a cam surface 84 formed therein. The cam surface 84 of the upper drive shaft 82 has a pair of inverted V-shaped surfaces 86 which meet at a pair of peaks 88 (note only one of the V-shaped surfaces 86 and one of the peaks 88 is shown in FIG. 4, with the other V-shaped surface and the other peak being obstructed from view in the perspective of FIG. 4 by the drive shaft 82). The lower transfer gear 78 has an upwardly extending drive shaft 90. As can be seen in FIG. 5, the distal end of the drive shaft 90 has a cam surface 92 formed therein. The cam surface 92 has a pair of V-shaped surfaces 94 which meet at a pair of peaks 96. As shown in FIG. 6, the V-shaped surfaces 94 of the lower transfer gear's cam surface 92 mate with (i.e., are received into) the inverted V-shaped surfaces 86 of the upper transfer gear's cam surface 84. When mated in such a manner, the cam surface 92 of the lower transfer gear 78 transfers torque to the cam surface 84 of the upper transfer gear 80. As such, when the V-shaped surfaces 86, 94 of the cam surfaces 84, 92, respectively, are mated with one another, rotation of the lower transfer gear 78 causes rotation of the upper transfer gear 80.

Figure 7:
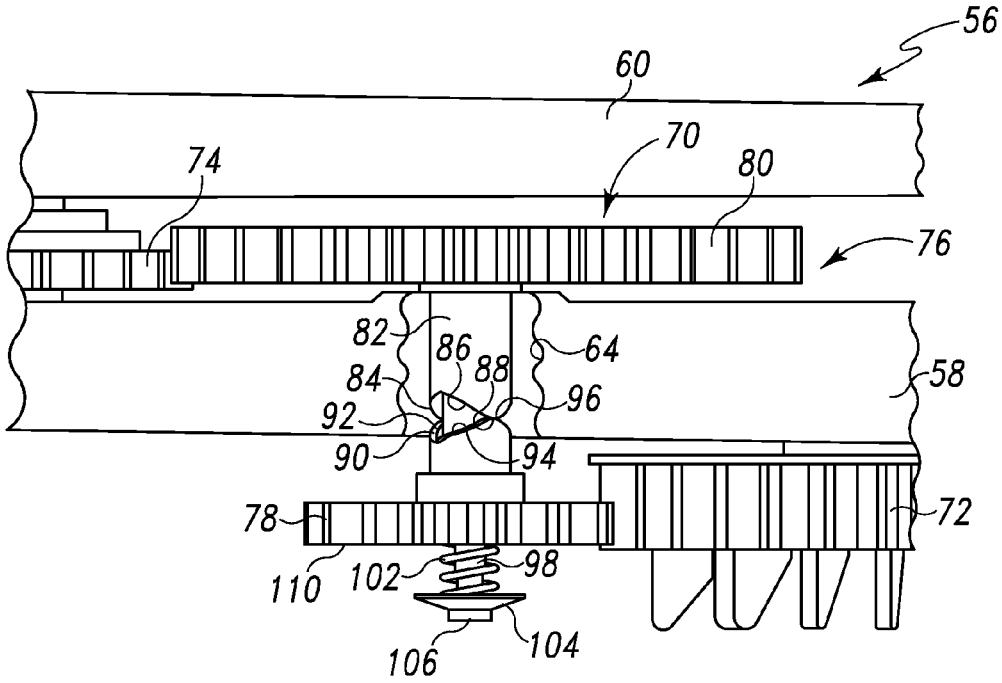
FIG. 7 is a view similar to FIG. 6, but showing the lower transfer gear positioned in its slip position.

As shown in FIGS. 4-7, the drive shaft 82 of the upper transfer gear 80 has a stem 98 extending downwardly therefrom. The drive shaft 90 of the lower transfer gear 78 is cannulated and, as such, has an elongated bore 100 extending through it. The stem 98 of the upper transfer gear 80 extends through the bore 100 of the lower transfer gear 78. As can be seen in FIGS. 6 and 7, a coiled spring 102 is positioned on the end of the stem 98. A fastener such as a push nut 104 is fastened to an annular flange 106 formed on the distal end 108 of the stem 98. The spring 102 is compressed between the push nut 104 and the bottom surface 110 of the lower transfer gear 78. As such, the bias of the spring 102 urges the lower transfer gear upwardly such that the V-shaped surfaces 86, 94 of the cam surfaces 84, 92, respectively, are urged into engagement with one another thereby locking the transfer gears 78, 80 to one another.

If rotation of the corner arm 60 is obstructed by, for example, a pot handle or spoon extending downwardly from the lower dish rack 16, rotation of the upper transfer gear 80 and hence its drive shaft 82 is likewise obstructed. As can be see in FIG. 7, if rotation of the upper transfer gear's drive shaft 82 is obstructed, the cam surfaces 84, 92 disengage one another thereby allowing the transfer gears 78, 80 to slip relative to one another. In particular, as the V-shaped surfaces 94 of the lower transfer gear's cam surface 92 continue to rotate against the stationary V-shaped surfaces 86 of the upper transfer gear's cam surface 84, the V-shaped surfaces 94 of the lower transfer gear's cam surface 92 ride up the stationary V-shaped surfaces 86 toward the peaks 88 of the cam surface 84. As the V-shaped surfaces 94 of the lower transfer gear's cam surface 92 ride up the obstructed V-shaped surfaces 86 of the upper transfer gear's cam surface 84, the lower transfer gear 78 is urged downwardly against the bias of the spring 102.

Once the peaks 96 of the lower transfer gear's cam surface 92 rotate beyond the peaks 88 of the upper transfer gear's cam surface 84, the V-shaped surfaces 94 of the lower transfer gear's cam surface 92 ride down the adjacent V-shaped surface 86 of the upper transfer gear's cam surface 84. As the cam surface 92 rides downwardly in such a manner, the spring 102 urges the lower transfer gear 78 upwardly such that the V-shaped surfaces 86, 94 of the cam surfaces 84, 92, respectively, are again urged into engagement with one another thereby locking the transfer gears 78, 80 to one another. If rotation of the corner arm 60 remains obstructed, continued rotation of the lower transfer gear 78 will again cause the transfer gears 78, 80 to slip relative to one another in a similar manner until the obstruction is cleared.

In operation, the wash pump 52 pumps wash fluid through its outlet 54 and into the center arm 58 thereby causing the center arm to rotate relative to the pump outlet 54. Pressurized wash fluid is advanced from the center arm 58 to the wing arm 62 where it causes rotation of the wing arm as it is sprayed out of the wing arm 62 through the wing arm's nozzles and onto the dish racks 16 (and hence the wares positioned therein).

Rotation of the center arm 58 also causes rotation of the corner arm 60. In particular, as the center arm 58 rotates about the pump outlet 54 (and hence the stationary center gear 72), the lower transfer gear 78 is driven (i.e., rotated) by the stationary center gear 72. If the corner arm 60 is not obstructed, the lower transfer gear 78 is urged upwardly into its drive position by the spring 102 such that the V-shaped surfaces 86, 94 of the cam surfaces 84, 92, respectively, are urged into engagement with one another thereby locking the transfer gears 78, 80 to one another.

With the transfer gears 78, 80 locked to one another, rotation of the center arm 58 causes rotation of the transfer gears 78, 80 and hence the input gear 74 of the corner arm 60 thereby causing rotation of the corner arm 60 relative to the center arm 58. It should be appreciated that the various gears of the gear train 70 are configured to cause rotation of the corner arm 60 in a manner that times the position of the corner arm 60. In particular, the gear train 70 times the position of the corner arm such that it is extended outwardly from (i.e., not positioned parallel to) the center arm 58 to "reach" into the corners of the tub 12, but retracted (i.e., positioned parallel with) the center arm 58 to provide clearance of the corner arm 60 relative to the side walls 36, 38 and the back wall 40 of the tub 12. During such timed rotation of the corner arm 60, pressurized wash fluid supplied from the center arm 58 is sprayed on the dish racks 16 (and hence the wares positioned therein) by the nozzles of the corner arm 60.

However, if rotation of the corner arm 60 is obstructed by, for example, a pot handle or spoon extending downwardly from the lower dish rack 16, rotation of the upper transfer gear 80 is likewise obstructed. Despite the obstruction, the lower transfer gear 78 continues to be driven by the stationary center gear 72 as a result of continued rotation of the center arm 58 relative to the pump outlet 54. As can be see in FIG. 7, when rotation of the upper transfer gear 80 (and hence its drive shaft 82) is obstructed, the lower transfer gear 78 is urged downwardly into a slip position against the bias of the spring 102 thereby causing the cam surfaces 84, 92 to disengage one another. This allows the transfer gears 78, 80 to slip relative to one another. In particular, as the V-shaped surfaces 94 of the lower transfer gear's cam surface 92 continue to rotate against the stationary V-shaped surfaces 86 of the upper transfer gear's cam surface 84, the V-shaped surfaces 94 of the lower transfer gear's cam surface 92 ride up the V-shaped surfaces 86 toward the peaks 88 of the cam surface 84. As the V-shaped surfaces 94 of the lower transfer gear's cam surface 92 ride up the obstructed V-shaped surfaces 86 of the upper transfer gear's cam surface 84, the lower transfer gear 78 is urged downwardly into its slip position against the bias of the spring 102.

Once the peaks 96 of the lower transfer gear's cam surface 92 rotate beyond the peaks 88 of the upper transfer gear's cam surface 84, the V-shaped surfaces 94 of the lower transfer gear's cam surface 92 ride down the adjacent V-shaped surface 86 of the upper transfer gear's cam surface 84. As the cam surface 92 rides downwardly in such a manner, the spring 102 urges the lower transfer gear 78 upwardly back into its drive position such that the V-shaped surfaces 86, 94 of the cam surfaces 84, 92, respectively, are again urged into engagement with one another thereby locking the transfer gears 78, 80 to one another. If rotation of the corner arm 60 remains obstructed, continued rotation of the lower transfer gear 78 will again cause the transfer gears 78, 80 to slip relative to one another in a similar manner until the obstruction is cleared.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. A dishwasher, comprising:

a tub defining a washing chamber, the tub comprises a bottom wall having a downwardly-sloped sump formed therein, a number of dish racks positioned in the washing chamber, a rotating spray arm assembly positioned in the washing chamber to spray wash fluid on the dish racks, the rotating spray arm assembly comprising:

a center arm that rotates relative to the bottom wall of the tub, a corner arm coupled to the center arm so as to rotate relative thereto, the corner arm having an input gear, an upper transfer gear coupled to the center arm and intermeshed with the input gear of the corner arm so as to drive rotation of the corner arm, the upper transfer gear having a downwardly extending drive shaft with a cam surface formed thereon, a lower transfer gear coupled to the center arm, the lower transfer gear having an upwardly extending drive shaft with a cam surface formed thereon, the cam surface of the drive shaft of the lower transfer gear is engaged with the cam surface of the drive shaft of the upper transfer gear such that rotation of the lower transfer gear causes rotation of the upper transfer gear, wherein the lower transfer gear is movable between a drive position in which the cam surface of the drive shaft of the lower transfer gear is engaged with the cam surface of the drive shaft of the upper transfer gear, and a slip position in which the cam surface of the drive shaft of the lower transfer gear is disengaged from the cam surface of the drive shaft of the upper transfer gear, wherein the upper transfer gear is driven by the lower transfer gear when the lower transfer gear is positioned in the drive position, and the upper transfer gear rotates freely of the lower transfer gear when the lower transfer gear is positioned in the slip position.

2. The dishwasher of claim 1, wherein:

the spray arm assembly further comprises a spring, the spring biases the lower transfer gear into the drive position, and movement of the lower transfer gear from the drive position to the slip position causes compression of the spring.

3. The dishwasher of claim 1, further comprising a stationary center gear, wherein:

the center arm rotates relative to the stationary center gear, and the lower transfer gear is intermeshed with the stationary center gear such that rotation of the center arm relative to the stationary center gear causes rotation of the lower transfer gear.

4. The dishwasher of claim 1, wherein:

the spray arm assembly further comprises a spring, the spring biases the cam surface of the drive shaft of the lower transfer gear into engagement with the cam surface of the drive shaft of the upper transfer gear.

5. The dishwasher of claim 4, wherein:

the drive shaft of the lower transfer gear has a bore extending therethrough, the drive shaft of the upper transfer gear has an elongated stem extending downwardly therefrom, the stem of the drive shaft of the upper transfer gear extends through the bore of the drive shaft of the lower transfer gear, and the spring is positioned on the stem.

6. A rotating spray arm assembly for a dishwasher, comprising:

a rotating center arm, a corner arm coupled to the center arm so as to rotate relative thereto, the corner arm having an input gear, an upper transfer gear coupled to the center arm and intermeshed with the input gear of the corner arm so as to drive rotation of the corner arm, the upper transfer gear having a downwardly extending drive shaft with a cam surface formed thereon, and a lower transfer gear coupled to the center arm, the lower transfer gear having an upwardly extending drive shaft with a cam surface formed thereon, the cam surface of the drive shaft of the lower transfer gear is engaged with the cam surface of the drive shaft of the upper transfer gear such that rotation of the lower transfer gear causes rotation of the upper transfer gear, wherein the lower transfer gear is movable between a drive position in which the cam surface of the drive shaft of the lower transfer gear is engaged with the cam surface of the drive shaft of the upper transfer gear, and a slip position in which the cam surface of the drive shaft of the lower transfer gear is disengaged from the cam surface of the drive shaft of the upper transfer gear, wherein the upper transfer gear is driven by the lower transfer gear when the lower transfer gear is positioned in the drive position, and the upper transfer gear rotates freely of the lower transfer gear when the lower transfer gear is positioned in the slip position.

7. The spray arm assembly of claim 6, wherein the center arm comprises a number of drive nozzles that cause rotation of the center arm when wash fluid is expelled therefrom.

8. The spray arm assembly of claim 6, further comprising a spring, wherein:

the spring biases the lower transfer gear into the drive position, and movement of the lower transfer gear from the drive position to the slip position causes compression of the spring.

9. The spray arm assembly of claim 6, further comprising a spring positioned to bias the cam surface of the drive shaft of the lower transfer gear into engagement with the cam surface of the drive shaft of the upper transfer gear.

10. The spray arm assembly of claim 9, wherein:

the drive shaft of the lower transfer gear has a bore extending therethrough, the drive shaft of the upper transfer gear has an elongated stem extending downwardly therefrom, the stem of the drive shaft of the upper transfer gear extends through the bore of the drive shaft of the lower transfer gear, and the spring is positioned on the stem.

11. A dishwasher, comprising:

a tub defining a washing chamber, the tub comprises a bottom wall having a downwardly-sloped sump formed therein, a number of dish racks positioned in the washing chamber, a center gear positioned in the washing chamber, a rotating spray arm assembly positioned in the washing chamber to spray wash fluid on the dish racks, the rotating spray arm assembly comprising:

a center arm that rotates relative to the bottom wall of the tub, a corner arm coupled to the center arm so as to rotate relative thereto, the corner arm having an input gear, a transfer gear assembly intermeshed with both the center gear and the input gear of the corner arm so as to drive rotation of the corner arm, the transfer gear assembly being operable to decouple the input gear from the center gear when rotation of the corner arm is obstructed, wherein the transfer gear assembly comprises:

an upper transfer gear coupled to the center arm, the upper transfer gear having a downwardly extending drive shaft with a cam surface formed thereon, and a lower transfer gear coupled to the center arm, the lower transfer gear having an upwardly extending drive shaft with a cam surface formed thereon, the cam surface of the drive shaft of the lower transfer gear is engaged with the cam surface of the drive shaft of the upper transfer gear such that rotation of the lower transfer gear causes rotation of the upper transfer gear, wherein the lower transfer gear is movable between a drive position in which the cam surface of the drive shaft of the lower transfer gear is engaged with the cam surface of the drive shaft of the upper transfer gear, and a slip position in which the cam surface of the drive shaft of the lower transfer gear is disengaged from the cam surface of the drive shaft of the upper transfer gear, wherein the upper transfer gear is driven by the lower transfer gear when the lower transfer gear is positioned in the drive position, and the upper transfer gear rotates freely of the lower transfer gear when the lower transfer gear is positioned in the slip position.

12. The dishwasher assembly of claim 11, further comprising a pump having an outlet that extends into the washing chamber through the bottom wall of the tub, wherein:

the center gear is non-rotatably secured to the outlet of the pump, and the center arm is rotatably secured to the outlet of the pump.

13. The dishwasher of claim 11, wherein:

the spray arm assembly further comprises a spring, the spring biases the lower transfer gear into the drive position, and movement of the lower transfer gear from the drive position to the slip position causes compression of the spring.

* * * * *